US012251025B2

(12) United States Patent
Pallett

(10) Patent No.: US 12,251,025 B2
(45) Date of Patent: Mar. 18, 2025

(54) MODULAR BUNK

(71) Applicant: SMART BUNKS IP PTY LTD, New South Wales (AU)

(72) Inventor: Damian Pallett, New South Wales (AU)

(73) Assignee: Smart Bunks IP Pty Ltd., New South Wales (AU)

( * ) Notice: Subject to any disclaimer, the term of this patent is extended or adjusted under 35 U.S.C. 154(b) by 249 days.

(21) Appl. No.: 17/416,285

(22) PCT Filed: Sep. 4, 2019

(86) PCT No.: PCT/AU2019/050940

§ 371 (c)(1),
(2) Date: Jun. 18, 2021

(87) PCT Pub. No.: WO2020/124127

PCT Pub. Date: Jun. 25, 2020

(65) Prior Publication Data

US 2022/0071402 A1 Mar. 10, 2022

(30) Foreign Application Priority Data

Dec. 20, 2018 (AU) ..... 2018904871

(51) Int. Cl.
*A47C 19/20* (2006.01)
*A47C 19/22* (2006.01)
(Continued)

(52) U.S. Cl.
CPC ..... *A47C 19/202* (2013.01); *A47C 19/22* (2013.01); *A47C 21/044* (2013.01); *E04H 1/02* (2013.01);
(Continued)

(58) Field of Classification Search
CPC ..... A47C 19/202; A47C 19/22; A47C 21/044; A47C 21/003; A47C 17/86; A47C 29/003;
(Continued)

(56) References Cited

U.S. PATENT DOCUMENTS 186,192 A * 1/1877 Baker ..... E05B 65/46 70/344
3,729,753 A * 5/1973 Johnson ..... A47C 17/22 5/2.1
(Continued)

FOREIGN PATENT DOCUMENTS

EP 0038363 A1 10/1981
WO 2018024209 A1 2/2018

OTHER PUBLICATIONS

International Search Report and Written Opinion for PCT/AU2019/050950 mailed Oct. 9, 2019, 8 pages.
(Continued)

*Primary Examiner* — Myles A Throop
(74) *Attorney, Agent, or Firm* — LOWENSTEIN SANDLER LLP

(57) ABSTRACT

A modular stackable bunk (1) having an elongate base (3), an elongate roof (10), a pair of ends (4, 5) spaced apart by a pair of sides (6, 7), at least partially connecting said base to said roof to form a living space (11). At least one raised portion (12) extends along said base and/or roof and adapted to elevate said base and/or roof away from a floor surface and/or another bunk. Attachment means (13) connect two said bunks together. A digital services package provides digital services to a user of said bunk.

12 Claims, 14 Drawing Sheets

(51) Int. Cl.

| | |
|---|---|
| ***A47C 21/00*** | (2006.01) |
| ***A47C 21/04*** | (2006.01) |
| ***E04H 1/02*** | (2006.01) |
| ***E04H 1/12*** | (2006.01) |

(52) U.S. Cl.
CPC .... *A47C 21/003* (2013.01); *E04H 2001/1283* (2013.01)

(58) Field of Classification Search
CPC ..... A47C 20/04; E04H 1/125; E04H 3/02; E04H 1/00; E04H 1/02; E04H 2001/1283
USPC ..... 5/9.1
See application file for complete search history.

(56) References Cited

U.S. PATENT DOCUMENTS

| | | | | |
|---|---|---|---|---|
| 3,858,254 | A * | 1/1975 | Coomes | A47C 17/32 5/8 |
| 3,931,653 | A * | 1/1976 | Bien | A47C 20/027 5/660 |
| 4,395,785 | A * | 8/1983 | Huh | E04H 1/005 5/8 |
| 4,505,078 | A | 3/1985 | Huh | |
| 4,594,817 | A | 6/1986 | McLaren et al. | |
| 4,745,643 | A | 5/1988 | Clarke | |
| D880,782 | S * | 4/2020 | Lomis | D30/108 |
| 11,674,301 | B2 * | 6/2023 | Cooper | B63B 29/02 52/64 |
| 2005/0037945 | A1 * | 2/2005 | Gygax | A61L 9/14 512/1 |
| 2007/0084135 | A1 * | 4/2007 | Ritter | E04B 1/3444 52/79.1 |
| 2008/0134589 | A1 * | 6/2008 | Abrams | E04B 1/34807 52/79.1 |
| 2013/0086849 | A1 * | 4/2013 | Clouser | E04H 1/00 52/79.9 |
| 2013/0185871 | A1 * | 7/2013 | Munden | A47C 21/003 5/658 |
| 2016/0040443 | A1 * | 2/2016 | Stephenson | E04H 1/005 52/79.5 |
| 2019/0271486 | A1 * | 9/2019 | Tully | F16M 13/02 |
| 2019/0335911 | A1 * | 11/2019 | Pawelczak | A47D 7/01 |
| 2019/0376303 | A1 * | 12/2019 | Wolff | E04B 1/348 |
| 2022/0162857 | A1 * | 5/2022 | Yelle | B32B 15/046 |

OTHER PUBLICATIONS

European Search Report for European Patent Application No. 19900322.9 dated Aug. 19, 2022, 7 pages.

* cited by examiner

MODULAR BUNK

CROSS-REFERENCE TO RELATED APPLICATION(S)

This application is a national phase entry under 35 U.S.C. § 371 of International Application No. PCT/AU2019/050940, filed on Sep. 4, 2019, which claims the benefit of priority of Australian Patent Application No. 2018904871, filed on Dec. 20, 2018. The contents of these applications are hereby incorporated by reference herein in their entirety.

FIELD

The present invention relates to a bed and in particular a bed that can be used as a bunk or the like and is modular in form.

BACKGROUND

Beds and bunks come in various shapes and sizes and are utilised throughout the world. Beds and bunks also come in a range of pricing from very expensive to the very cheap. Accommodation for travelers and students also varies from cheap to very expensive. With the increase in world populations land costs have significantly increased, making real estate expensive. Hotel rooms must therefore be priced accordingly. This significantly disadvantages travelers on lower budgets such as backpackers, students, families and the like. These types of travelers tend to utilise the services of low cost hotels, motels, backpacking or student establishments (hostels) or the like.

Some of these establishments are also in tourist locations which have high square metre pricing. Accordingly, a bunk style bed is utilised to provide more beds per square metre and offset costs.

Referring specifically to bunks, for example, bunks typically include a steel frame having four posts and a frame holding a mattress. These are very fragile and also noisy. There are also the "Japanese capsule" style beds which are typically a plastic box which can be placed on top of each other like kids toy blocks. These capsules are however very claustrophobic, flimsy, are not inviting and only come in a single configuration.

Backpackers, as an example, enter a country for only a few months and many of them (in Australia for example) opt to do some agricultural work to be granted a visa extension. They tend to spend their savings partying and not working, then get jobs typically in hospitality and labouring when their savings run low. They find it hard to get a good night sleep living in a dorm or a hostel when in work mode rather than party mode. They often then seek private furnished apartments or house shares to escape the unpleasant hostel sleeping environments.

Hostel dorms, for example, range from 4 to 12 person share typically. Some hostels have female dorms, male dorms and/or mixed dorms. They all have their own range of policies and building configuration. Some rooms may have regular single beds (not bunks), some a combination.

Hostels often also have private rooms with a double bed for couples or families. There is little privacy in dorms and the cost per person typically increases 50% upgrading a couple to a private room. Hostels typically do not have ensuite bathrooms. They use shared bathrooms "down the corridor" meaning the backpackers have to exit the dorm at night to go to the bathroom, disturbing their dorm neighbors.

Local Councils and other Government bodies grant maximum occupancy based on the size of the hostel. The higher the maximum allowable number of tenants, the more valuable that hostel is. Smart use of space is therefore a key factor to a profitable hostel. To this end, ceilings also tend to be high allowing the use of bunks.

There is often nowhere to sit in a dorm. To sit on the edge of a lower bunk involves bowing your head uncomfortably as the height of a top bunk is too low for an average height person to sit upright. Dorms often have no chair or desk. The tenant sits in their bunk with their laptop on their lap and back propped up with pillows. They often sit on the floor leaning against the bunk. This creates a hazardous situation and bad posture.

Privacy is also of concern. It is common to see a lower bunk backpacker draping a sheet from the above bunk to act as a privacy curtain creating a private space.

Typically the floor of a dorm will be messy with wires, phone chargers, laptop chargers, hair straighteners, fans, extension cables and multi power outlet strips daisy-chained off each other to service the many electrical devices each person is using in the dorm, again creating a hazardous environment and breaching fire regulations. Dorms are also very noisy. Not just the squeaky bunks but standard earphones are not effective against people talking to each other, on Skype™, on game consoles or the like.

Hostels generally have a common lounge room with a TV and sofas. They typically do not have TV's in dorms. Backpackers are more likely to watch a movie on their laptop in their bunk with earphones.

Hostels generally have central lockers where the backpacker provides their own padlock. It is a frequent occurrence for someone to be robbed in a hostel. Most backpackers will leave their passports and laptops in their suitcase or backpack on the floor of the dorm. They do not have lockers big enough to store all their stuff. The items take up floor space and add to the clutter of chargers, extension cables and the like.

Many male backpackers get labouring jobs and the smell of their socks and steel toe-capped boots on the dorm floor next to their high vis vest can provide a very unpleasant smell to endure while trying to sleep.

It is also often too expensive for hostel owners to provide air conditioning or heating.

A further problem for hostels is "bed bugs". They bite through the mattress surfaces to get into it which allows pest controllers a barometer to assess the size of the outbreak and how new or old the problem is. Then the backpackers travel and spread the bugs to other hostels. The cost and revenue losses of bedbug outbreaks is huge to hostel owners. Sometimes a dorm needs to be vacant for up to 6 weeks for pest control treatments.

Accordingly, there is a need to provide an improved hostel experience by providing a smart bed bunk system, which reduces the current hazardous, unsafe and unhygienic environment.

OBJECT

It is an object of the present invention to substantially overcome or at least ameliorate one or more of the disadvantages of the prior art, or to at least provide a useful alternative.

SUMMARY

There is disclosed herein a modular stackable bunk, the bunk having:

an elongate base, an elongate roof, a pair of ends spaced apart by a pair of sides, at least partially connecting said base to said roof to form a living space;

at least one raised portion extending along said base and/or roof and adapted to elevate said base and/or roof away from a floor surface and/or another bunk, attachment means to connect two said bunks together; and a digital services package to provide digital services to a user of said bunk.

Preferably, said base is manufactured from plywood.

Preferably, said bunk is coated with an anti insect repellant and/or mould repellant.

Preferably, the attachment means includes at least one hole in said base and/or said roof.

Preferably, said fastener includes a nut and bolt adapted in use to secure a base of one bunk with a roof of another bunk.

Preferably, said base and/or roof base have a plurality of raised portions, said raised portions defining channels to receive cabling and provide air flow.

Preferably, said bunk includes a ventilation system to circulate air about said bunk, said ventilation system adapted to deliver an insect repellant and/or mould repellant to said circulating air.

Preferably, said base includes a top surface and a bottom surface, said top surface being generally planar and defining a generally horizontal axis, said surface having a panel movable with respect to said planar surface to provide a user a support angled from said axis so that the user can sit up in bed.

Preferably, said sides include a surface adapted to receive advertising.

Preferably, said end and/or sides include a surface adapted to receive a television.

Preferably, said end and/or sides include a foldout table.

Preferably, said sides include a closed panel and an open cut out, said open cut out including a retractable privacy screen.

Preferably, said bunk includes a lockable drawer.

Preferably, said digital services package of one said bunk is adapted to communicate with a digital services package of another said bunk and/or a central server, to permit communication between said bunks and/or server and/or record data of bunk usage.

Preferably, said end includes a removable services panel.

Preferably, said side includes a tray holding a mattress and slidable away from said bunk to allow easy making of a bed.

Preferably, said side includes a hinged flap movable from an open position to a closed position, providing access to a mattress to permit sheets on said mattress to be changed easily.

BRIEF DESCRIPTION OF DRAWINGS

A preferred embodiment of the invention will now be described, by way of example only, with reference to the accompanying drawings, wherein.

DESCRIPTION OF EMBODIMENTS

Figure 1:
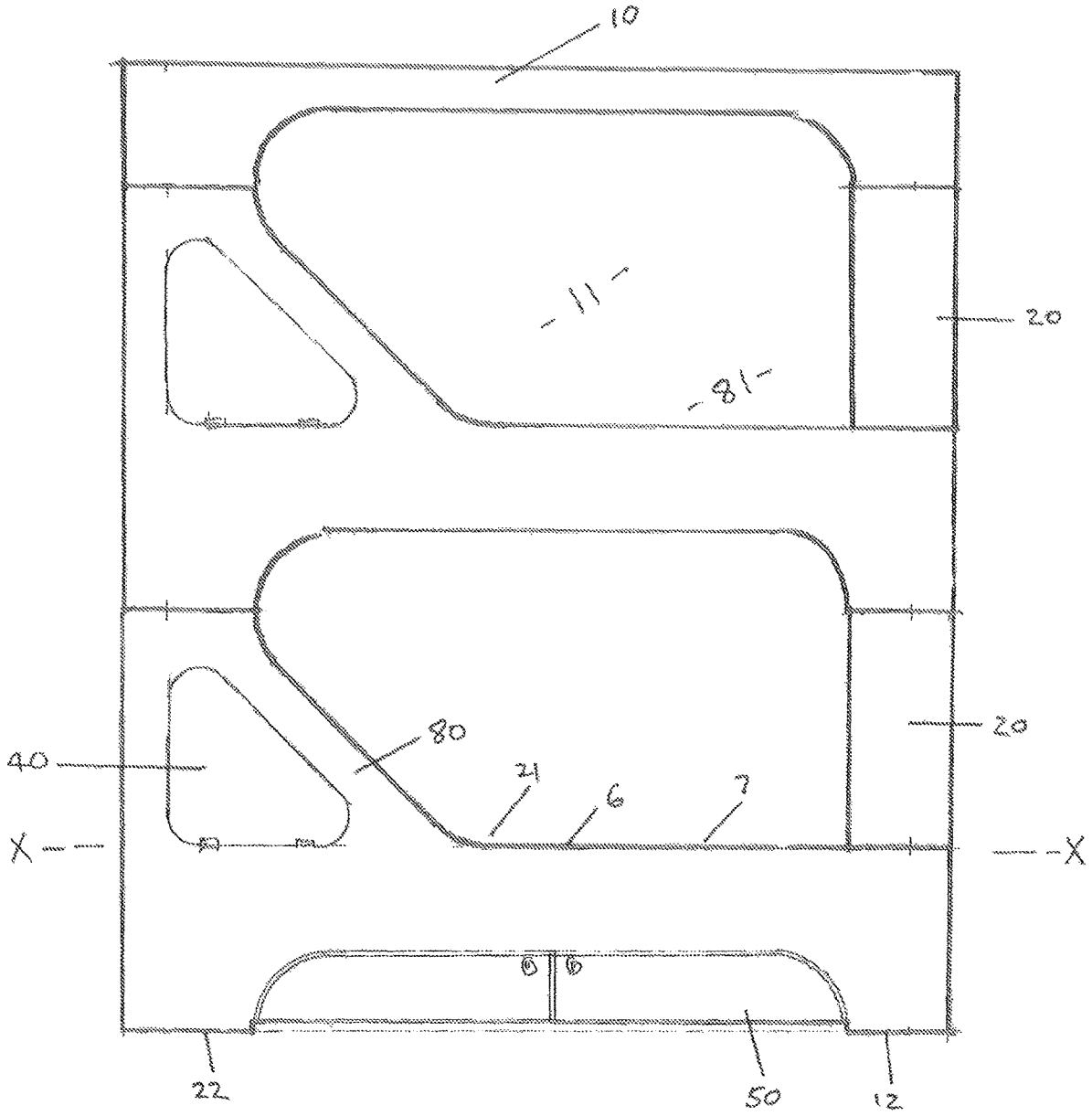
FIG. 1 shows a bunk bed in accordance with an embodiment of the present invention.
Figure 2:
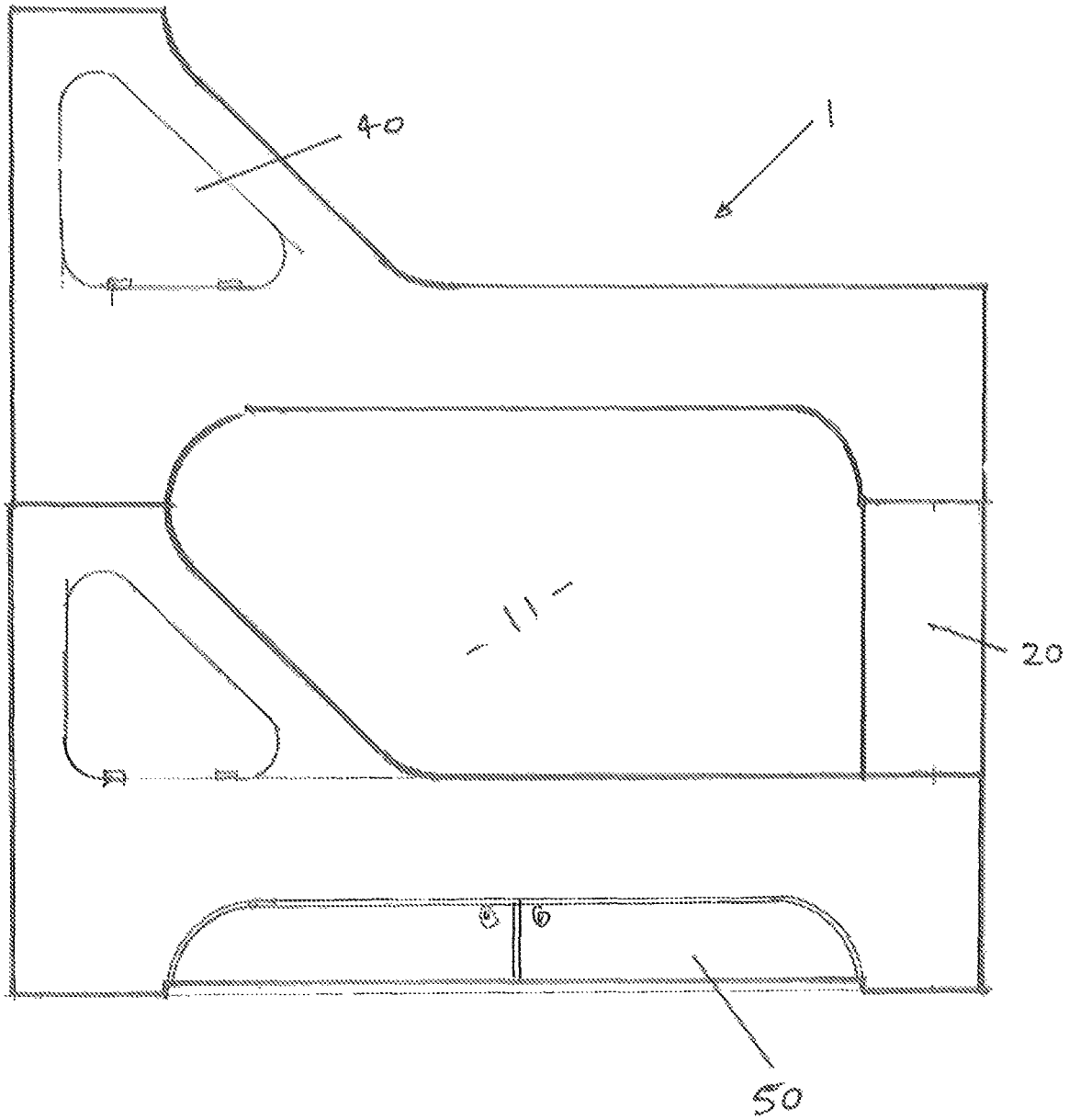
FIG. 2 shows a bunk bed in accordance with an embodiment of the present invention.

Referring to the drawings there is disclosed a modular bed bunk 1 having an elongate base 3, an elongate roof 10, a pair of ends 4 and 5 spaced apart by a pair of sides 6 and 7 at least partially connecting said base 3 to said roof 10 to form a living space 11. At least one raised portion 12 extends along said base 3 and/or roof 10 and is adapted to elevate the base 3 and/or roof 10 away from a surface and/or another bunk 1. Attachment means 13 are located on said base 3 and/or roof 10 and ends, sides 4, 5, 6, 7 and are adapted to receive fasteners (not shown) such as nuts, bolts or the like.

Figure 3:
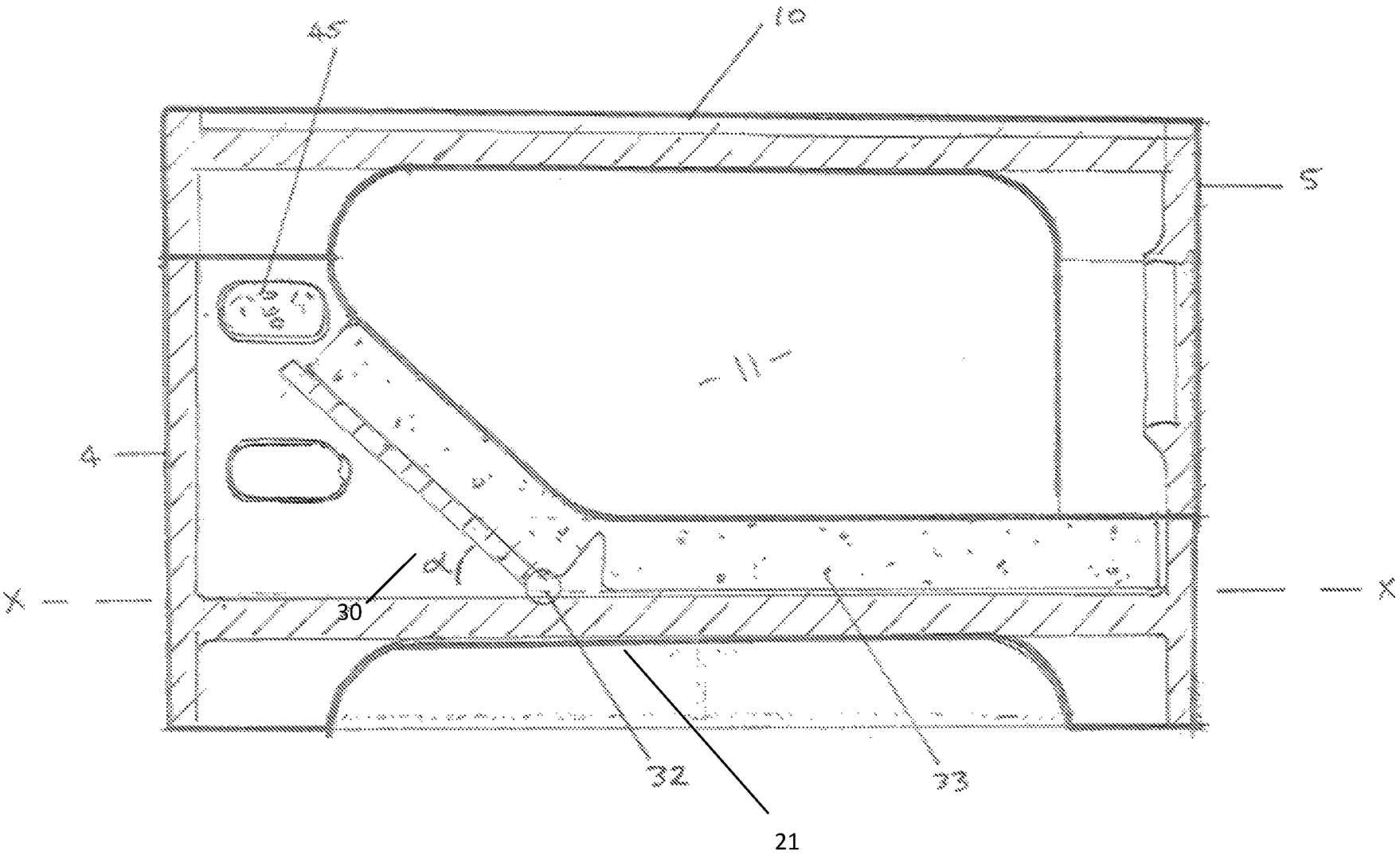
FIG. 3 shows a bunk bed in accordance with an embodiment of the present invention.
Figure 4:
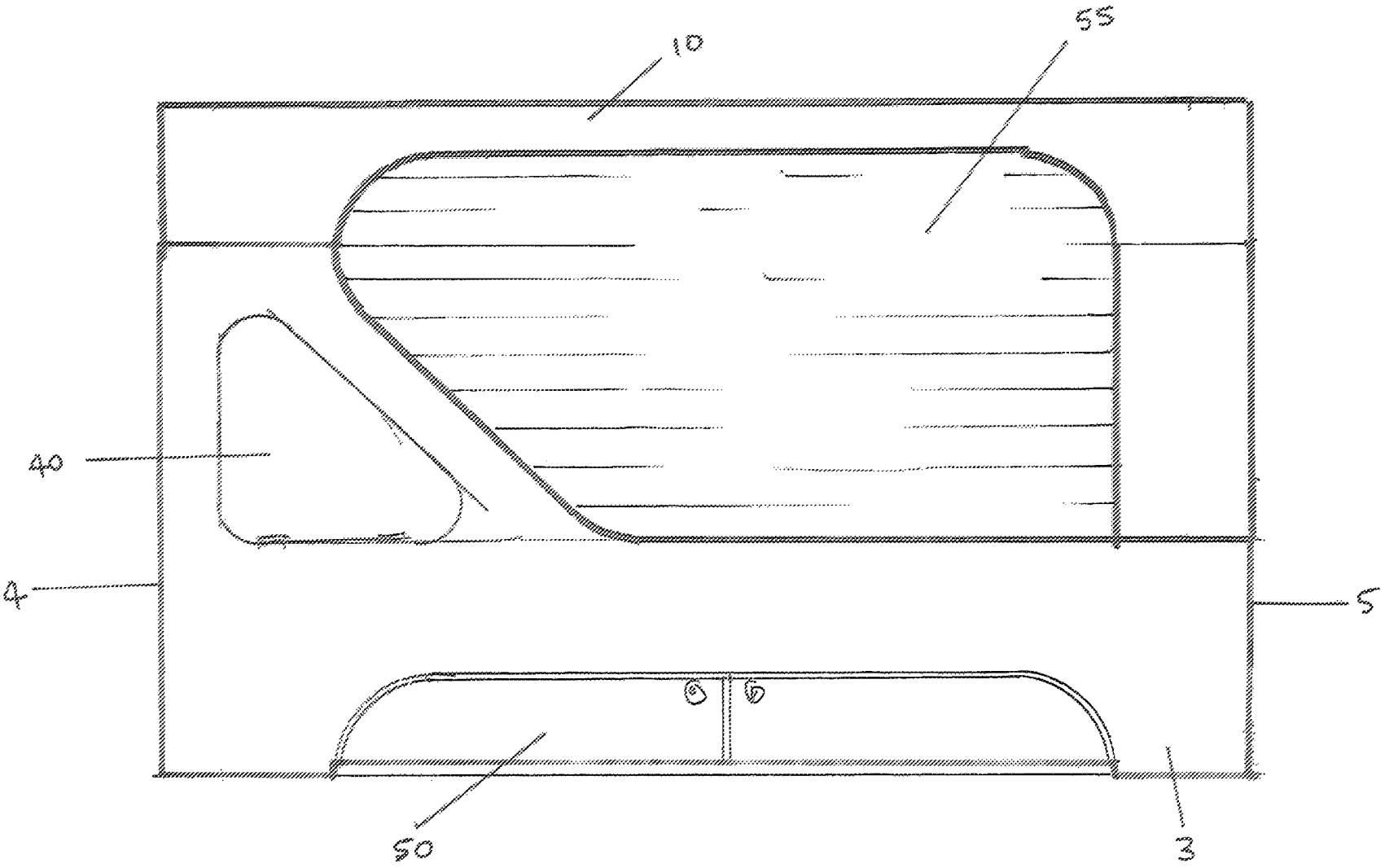
FIG. 4 shows a bunk bed in accordance with an embodiment of the present invention.
Figure 5:
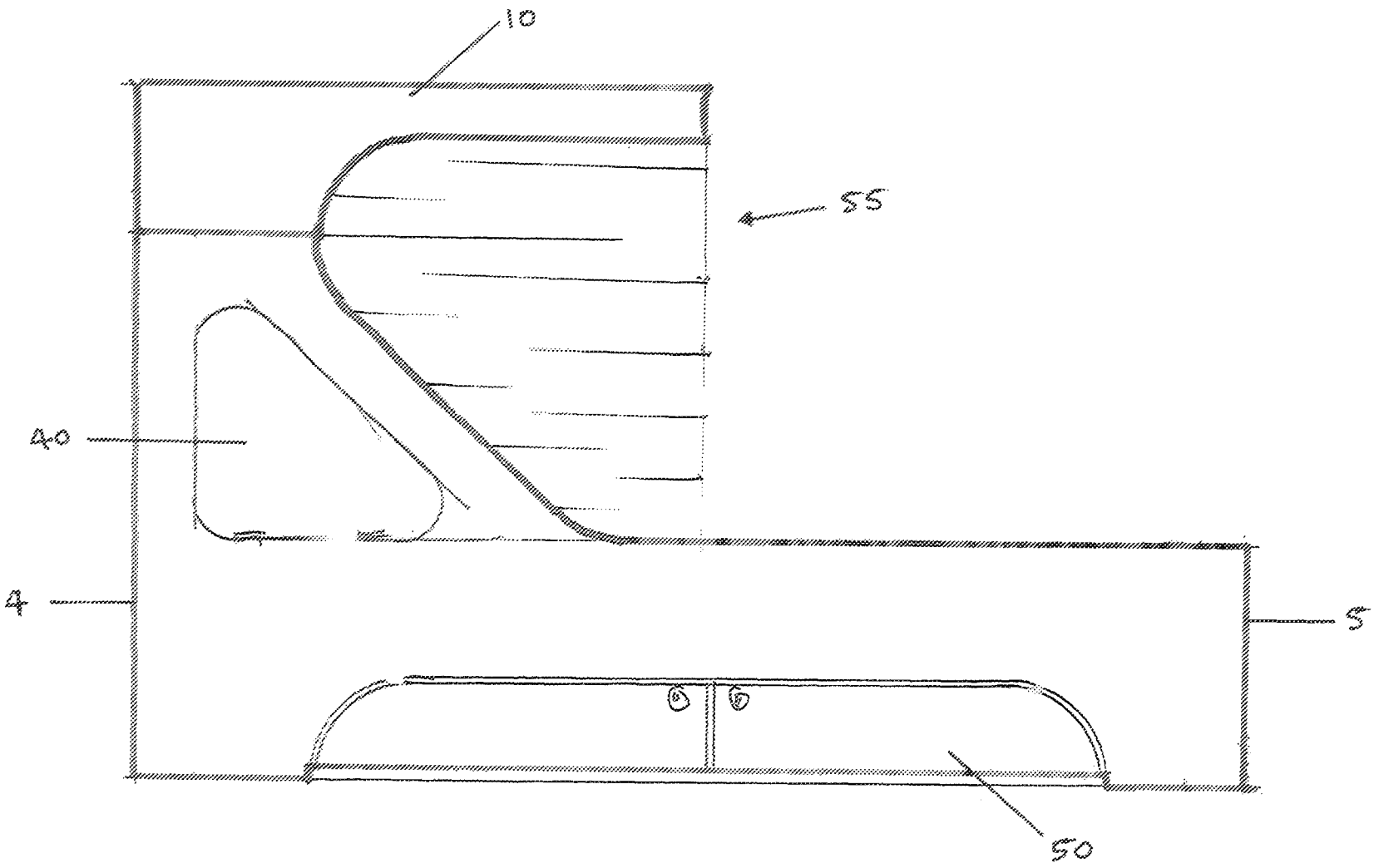
FIG. 5 shows a bunk bed in accordance with an embodiment of the present invention.
Figure 6:
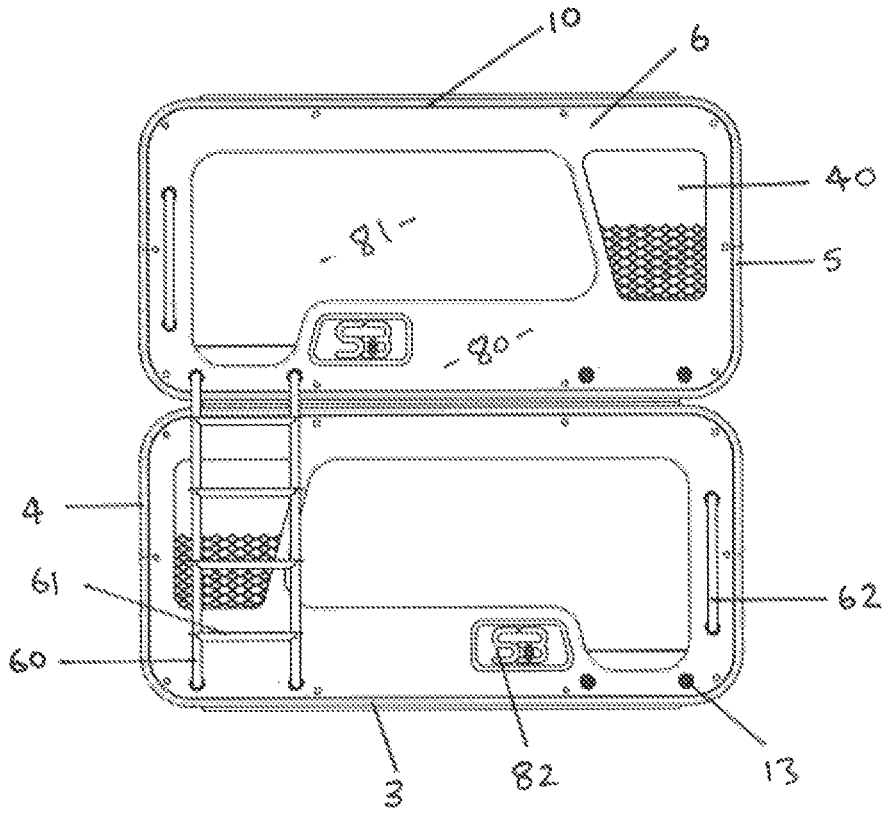
FIG. 6 shows a bunk bed in accordance with another embodiment of the present invention.
Figure 7:
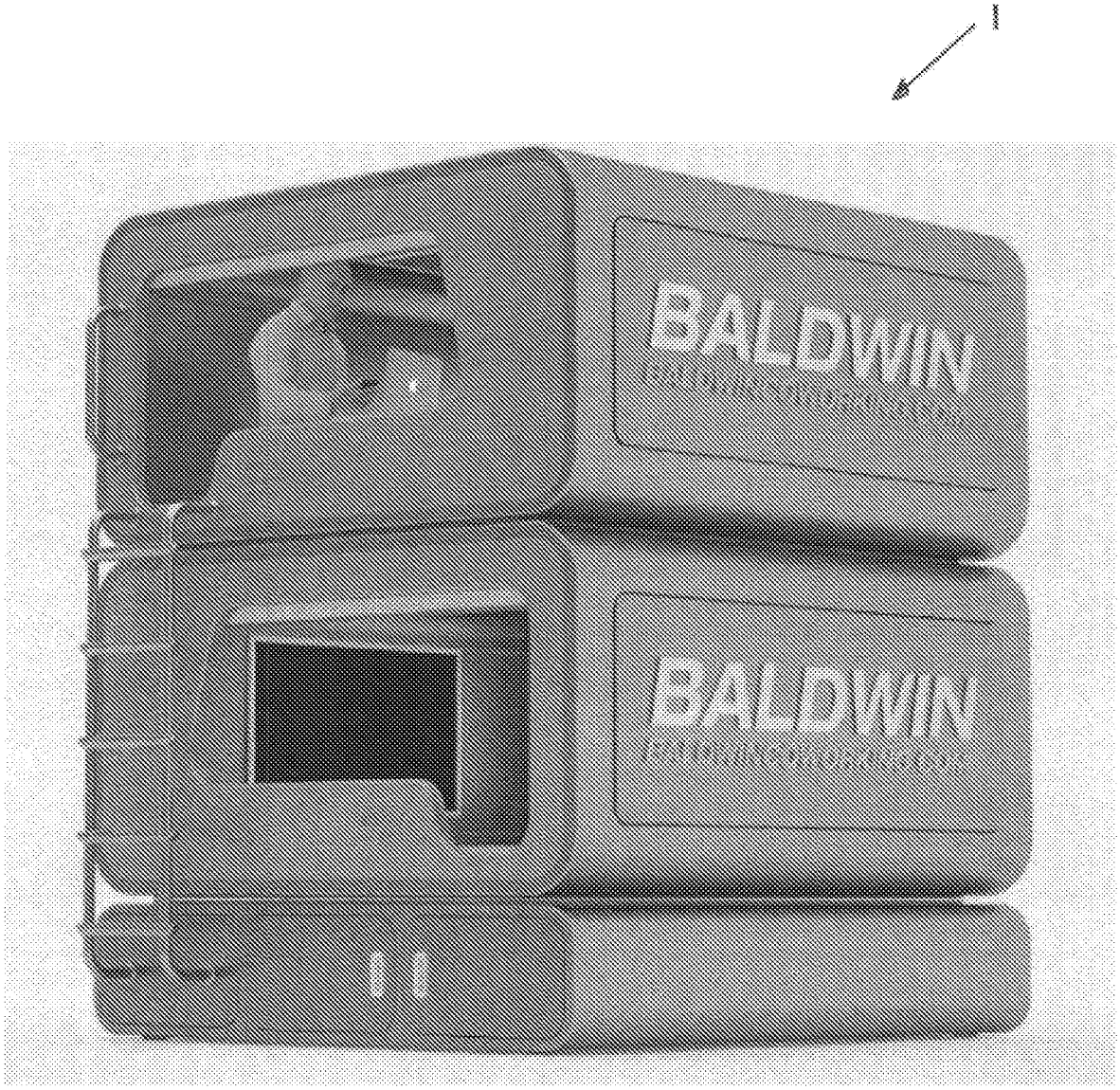
FIG. 7 shows a bunk bed in accordance with another embodiment of the present invention.
Figure 8:
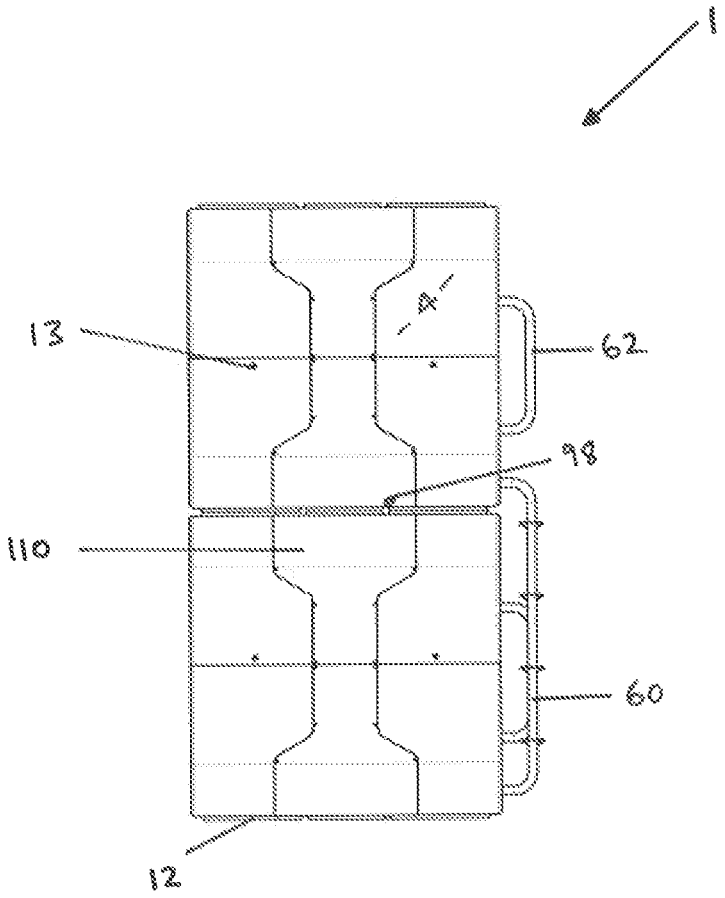
FIG. 8 shows a bunk bed in accordance with another embodiment of the present invention.
Figure 9:
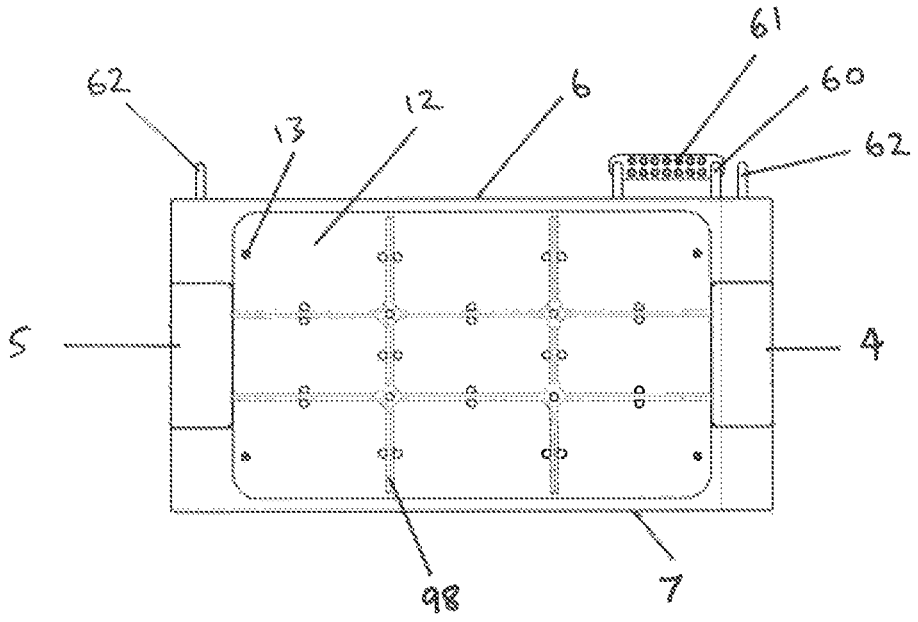
FIG. 9 shows a bunk bed in accordance with another embodiment of the present invention.
Figure 10:
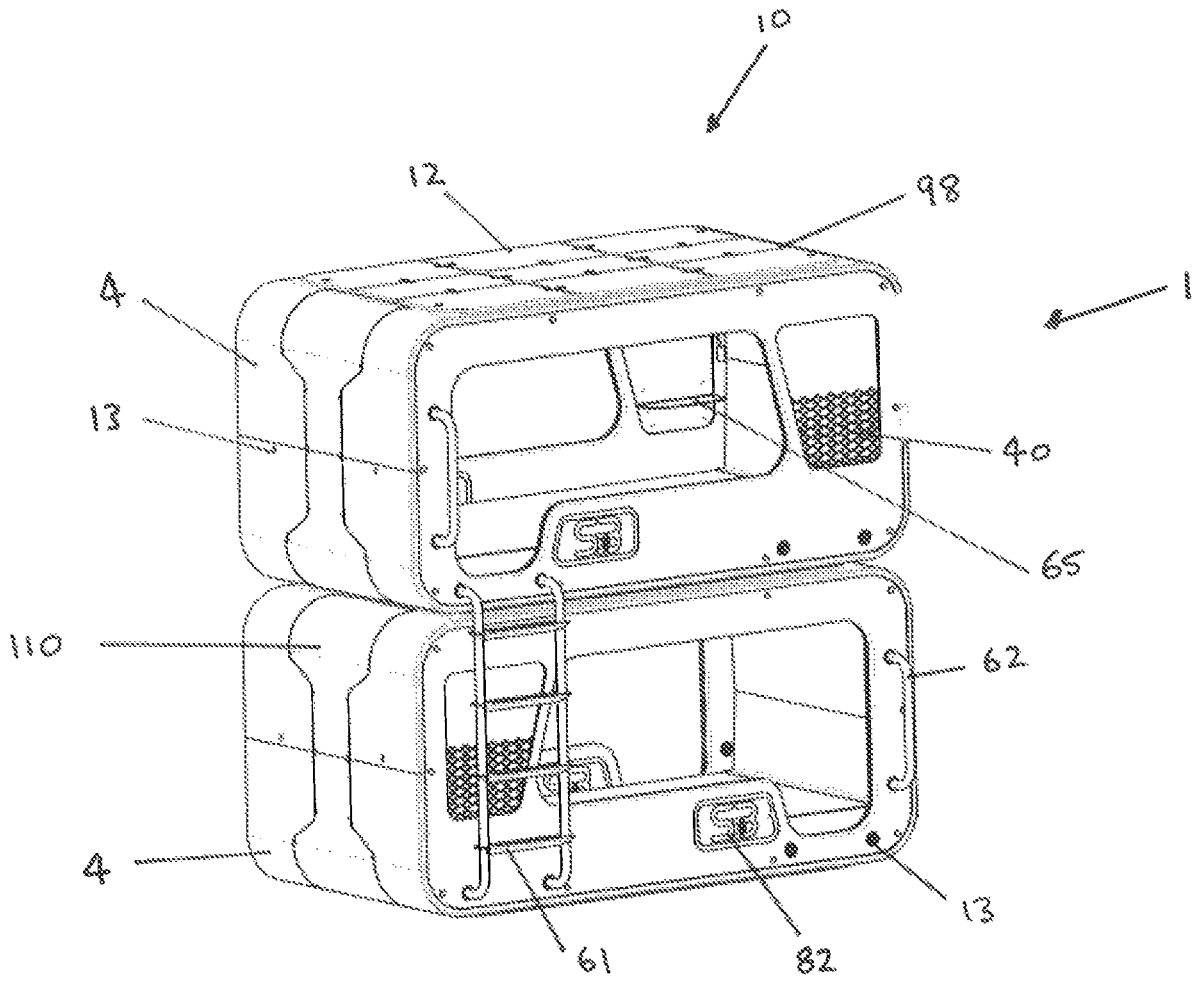
FIG. 10 shows a bunk bed in accordance with another embodiment of the present invention.
Figure 11:
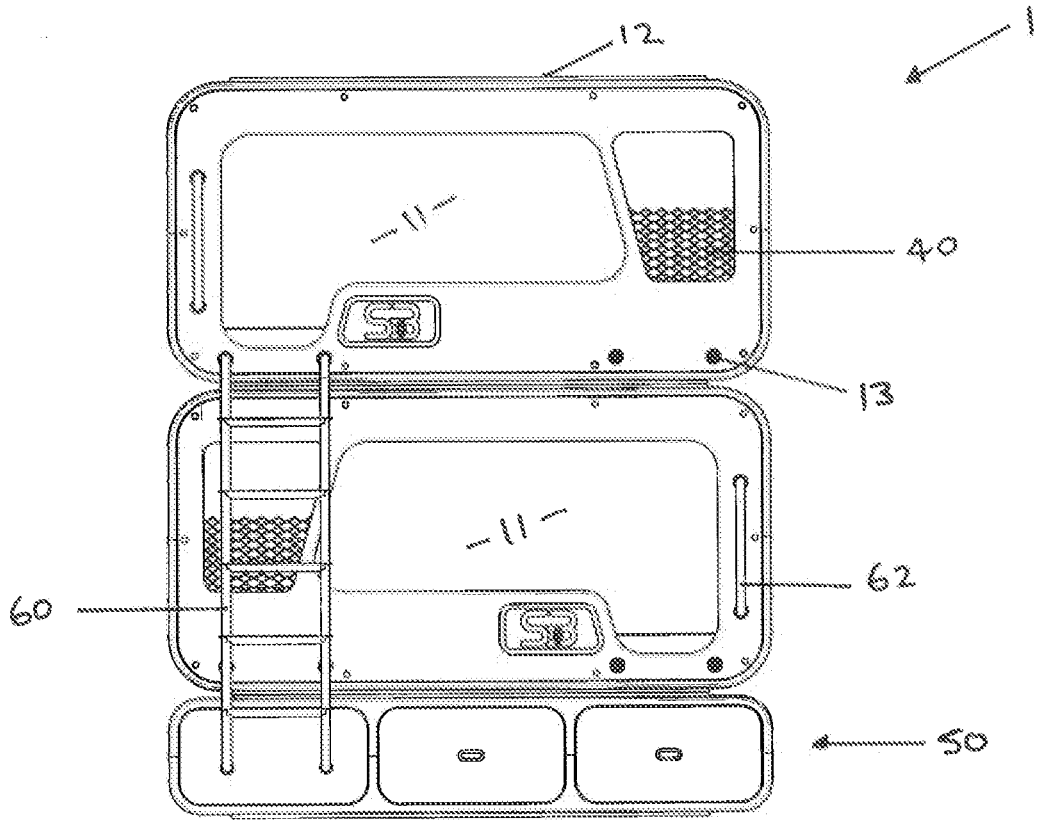
FIG. 11 shows a bunk bed in accordance with another embodiment of the present invention.
Figure 12:
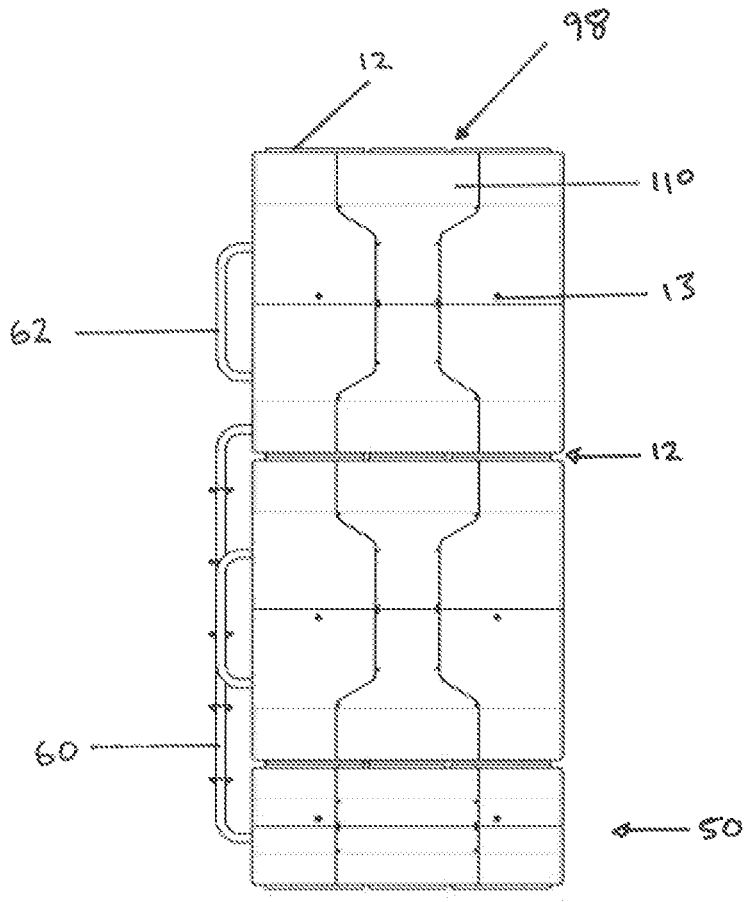
FIG. 12 shows a bunk bed in accordance with another embodiment of the present invention.
Figure 13:
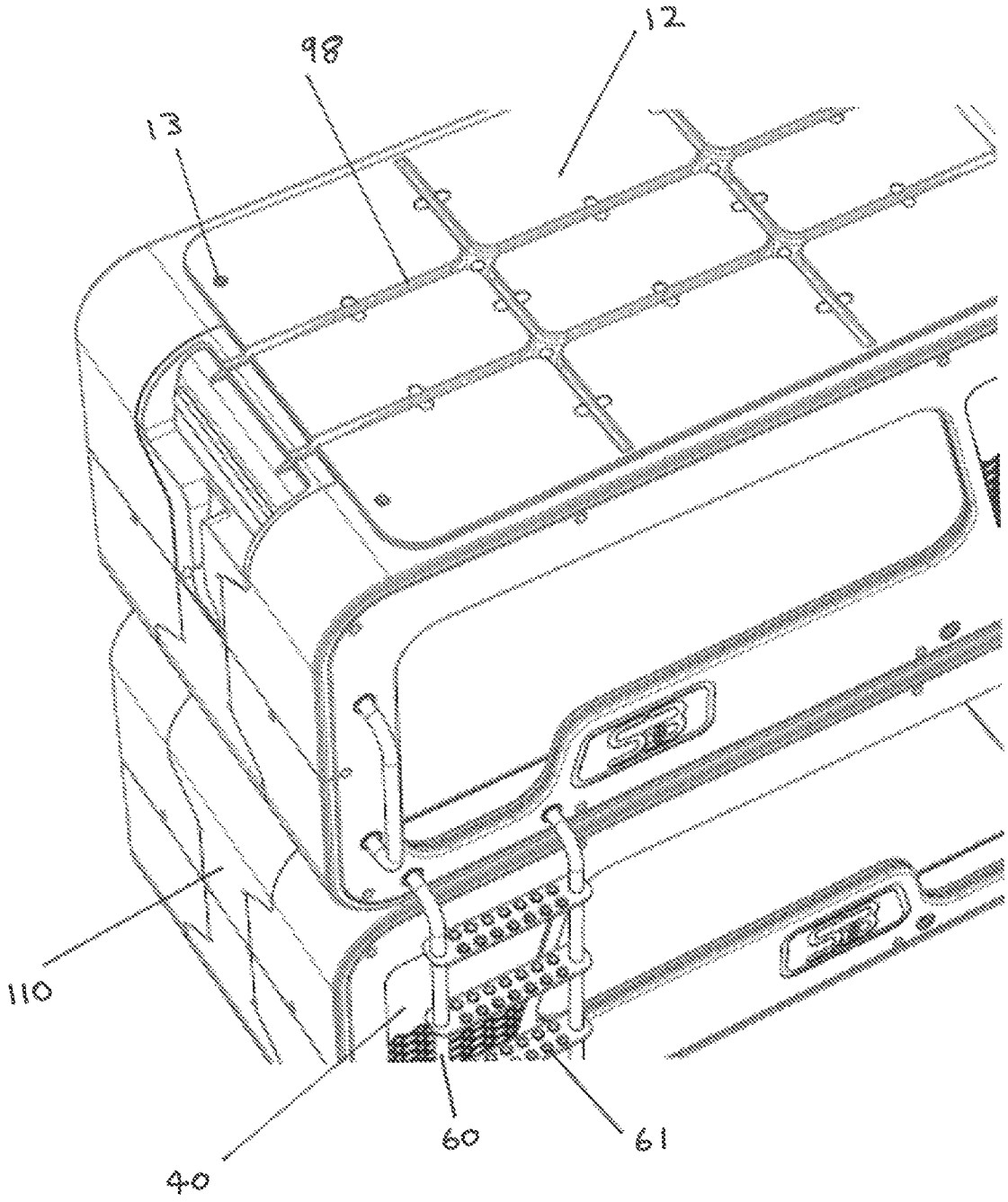
FIG. 13 shows a bunk bed in accordance with another embodiment of the present invention.

In a preferred form, the bunk 1 is manufactured from either a plywood or a plastic material. The bunk 1 could be a single molded unit. However, in one form will be manufactured in several pieces and transported to site for assembly on site. In one form, the base 3 includes a top surface 21 and a bottom surface 22. The top surface 21 being generally planar and defining a horizontal axis XX. The surface 21 having a panel 30 as best seen in FIG. 3 movable with respect to the planar surface and axis XX to provide a user a support angled a from the axis XX. This would provide a user a more comfortable means of sitting up in the living space 11 to read, watch television, converse with others or the like. The panel 30 could include a hinge 32 and a locking mechanism or the like. A mattress 33 could be placed on top of the surface 21.

In another form, the sides 6, 7 include a closed panel 80 and a cut out 81. The closed panel 80 can include advertising 82 or the like and a shelf, cupboard or the like 40. Within ends or sides 4, 5, 6, 7 there could be a surface adapted to receive a television 93, table 65, mirror 94, electronic connectors 45 or the like. The bunk 1 could also include lockable drawers 50. The drawers 50 could include a lockable safe, shoe odour container or the like. In another form, a mini fridge (not shown) or ice machine (not shown) could be included. The drawers 50 could be sized to hold a suitcase.

In the form shown in FIG. 1, the bunk 1 could include a second bunk located on top of it which includes a removable roof 10. The sides 6, 7 or base/roof 3,10 could also include a retractable privacy screen or curtain 55 to extend the privacy of the living space 11. The screen 55 could be pulled down and be lockable in place. The screen 55 could also include different fabrics to act as a shade, a block out or the like or even a space for additional advertising.

In an alternate form, the bunk 1 could be designed whereby 3 sets of double bunks are in a "U" shape, with two seating positions on each side of the bunks (each single bed=4 outward sitting provisions). This could strategically provide a comfortable forum for all 6 tenants to sit facing each other comfortably while they socialize without the need for chairs in the room. Any combination of bunk configurations could be utilised to suit the room size of the accommodation.

Unlike Japanese capsule hotel sleeping pods, the bunk 1 of the present invention is non-claustrophobic, not flimsy, provides a pleasant living space 11 yet offers some privacy and can be configured in many arrangements.

The invention, in a preferred form, also includes a ladder 60 having non-slip ladder rungs 61. A separate handle or the like 62 could be provided and integrated into the bunk 1 via the attachment means 13. A support member 20 is included to support the roof 10 and/or second bunk. The bunk 1 could include drink and phone holders or a shelf 65 or the like. There could be included a projector to watch videos, tv, computer devices on a wall of the bunk. There could be a virtual keyboard and a magnifying device or panel to help expand a field of view.

Figure 14:
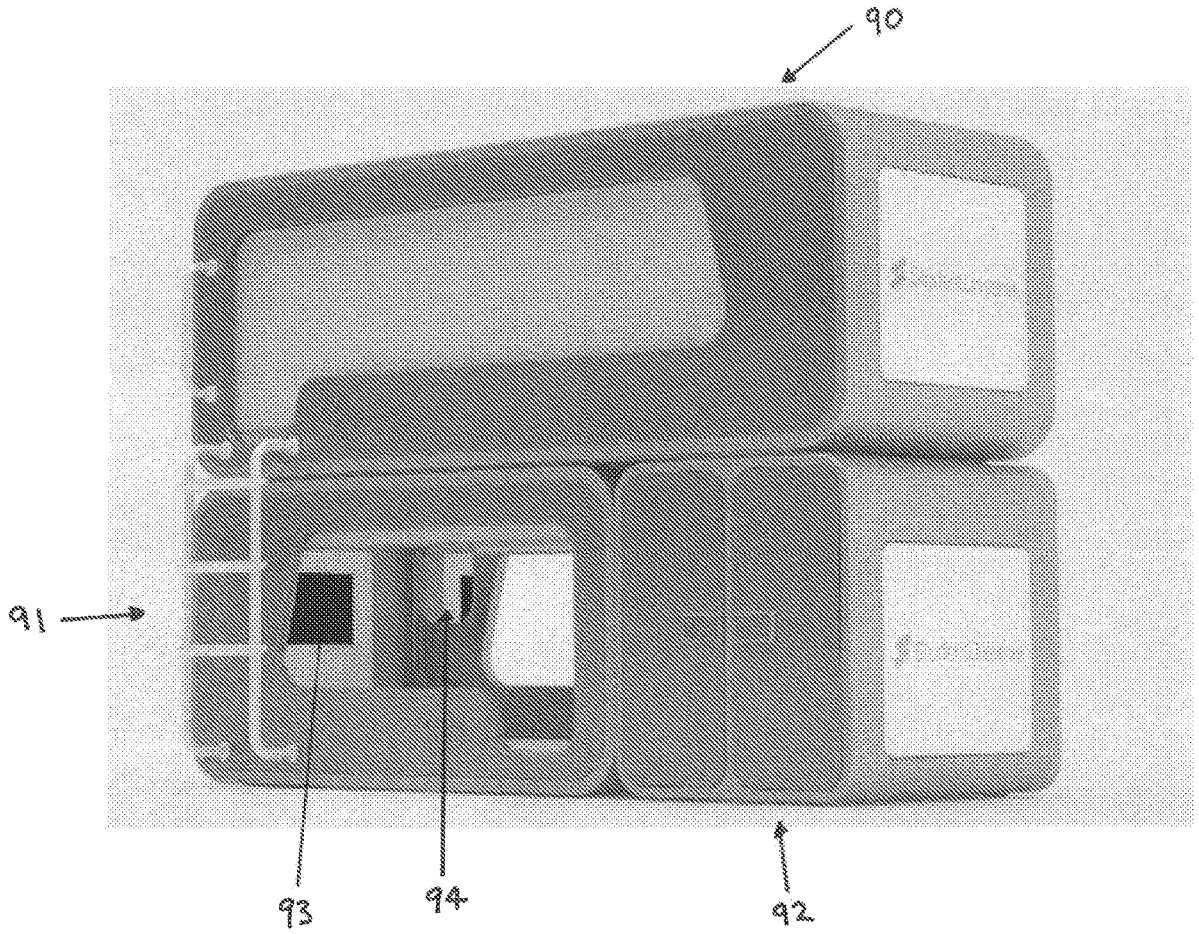
FIG. 14 shows a bunk bed in accordance with another embodiment of the present invention.

Also provided are double bed bunks. This provides an "in between option" in between a regular dorm and a private room. There is an element of frustration with single bunk beds not being comfortable for two backpackers. Couples often have to sleep a few meters apart or even in opposite sex dorms depending on availability. As shown in FIG. 14, there can also be a family style with a double bed 90 above a kids bed 91 with a longer wardrobe 92 available.

In one form, mobile applications integrated into the bunk 1 via the channels 98 and removable services area/panel 110 (See FIG. 18) provide bookings of accommodation and adventure tours and camper van rentals or any other product or services. They provide real time advertising space 82 as well. A small ventilation or cooling means such as heater or fans (not shown) can be included in the services area 110. This could be similar to air con blowers on airplanes and could require a credit card payment to operate or the like. The circulating air can reduce smells and assist with sleeping. A vapor injector could inject insect repellant and/or mould repellant into the circulating air.

In an alternate embodiment, the bunk 1 and privacy screen 55 could be locked and only operable by registering on a website and paying a deposit. With a Smartphone ID sign-in/check-in process identifying which bunk 1 the backpacker has previously slept in could provide for bed bug origin tracing. For example, a backpacker checks out of a hostel complaining the bed is infected. The hostel management quarantines the dorm and calls in the pest controllers. That backpacker could receive emailed advice of how to eliminate the bed bugs from their luggage to avoid spreading them to another hostel, and if they check into another hostel they will be flagged as having been infected previously. Then the reception staff can enquire if the problem has followed them around and choose to accept or reject the backpacker at their discretion.

The data collection system on a bunk 1 could also accumulate a "blacklist" of bad tenants who have been asked to leave a hostel for whatever negative reason. The hostel staff can input notes describing why they rejected or evicted a backpacker from the hostel. This information can be available to all hostels in the network and automatically flag online bookings in the name of a blacklisted person.

The same aspect of monitoring the journey of a backpacker offers various other merits. The system will provide risk mitigation through centralized data about the backpacker's whereabouts. A mobile application that accesses their GPS could be part of the solution. Sometimes drifters/homeless/criminal people use backpacker hostels to stay in and rob them or deal drugs to the backpackers in them. The system could reduce risk of bad characters checking into hostels. The bunk 1 could also include pressure sensors (not shown) or the like to identify if a person slept in the bunk on a particular night. A significant quantity of data can be collected about backpacker uses, preferences and habits by way of the smart bunk digital systems.

GPS access via the bunk 1 could offer local deals to the backpacker if they click on a screen on the side 6/7 to allow offers to be received forming a direct marketing service.

As mentioned the bunk 1 can include in the digital services package a screen or other electronic display means 82 on the outside of the bed so a 12 bed dorm has 12 screens displaying advertising 82. Such advertising would create a revenue stream which is important for the business model intended whereby the bunks 1 are installed for free, the old bunks are removed for free (possibly even sold to a second hand furniture dealer and the net proceeds paid to the hostel owner). A percentage of the revenue could be paid to the hostel owner. This dynamic ensures a saleable value proposition to the hostel owner so the revenue generation aspect is important. The bunk 1 could also monitor electricity use and charge according to use via the services area/panel 110. A panic button or reception button (not shown) can be included. The bunk 1 can include a mobile messaging service to message other bunks in the same location or elsewhere or reception. The digital services package of each bunk could communicate to each other and/or a central server to allow communication between bunks or even hostels and a central server and collect data on bunk usage.

The second revenue stream could be from the backpackers paying a small fee to use the bunk functionalities. Some fundamental key features could ensure 100% usage of the bunk features in addition to using it simply to sleep in. A type of "loyalty rewards scheme" could be included and even "micro-loans" being granted to backpackers entering services and be repayable from future Superannuation refunds achieved several months after they leave. Movie streaming set top boxes (not shown) could also be integrated into the bunks 1. A third revenue stream comes from the sale of the collected data.

The bunk 1 can be produced in International variations for global markets such as differing voltages, plug socket variations, and all other country-specific factors that would naturally affect the design variations and have a remote access online software diagnosis system built in to the bunk 1.

The bunks 1 could also have a red or blue light to suit the sex of the tenant or several different lighting options for the user, such as reading lights or emergency lights. Other safety equipment such as a smoke detector or fire extinguisher can also be included. A sensor could also detect if a user has stopped breathing and automatically notify reception.

The bunk 1 could have an electronic "personality" welcoming the backpacker to the bunk and able to give "roboadvice" for backpackers. For example the artificial personality could list some typical categories backpackers often enquire about. For example, "would you like me to provide any information about the following subjects: Tax Refunds, Superannuation Refunds, Cheapest Car Rental, Backpacker Social Gatherings, Music Festivals, Travel Hazards, Travel Tips, Travel Insurance, Local Laws, Local Special Deals, Competition Entry, Job Hunting Tips," etc.

The external screen or panel 82 could, in addition to displaying advertising, also display travel news or the like.

The bunks 1 could be all linked via the digital services package and provide users a weekly competition whereby somebody in each hostel wins something. The internal screen or panel 93 could have a camera for the purpose of using Skype™ or the like.

Backpackers sometimes use their phones to set an alarm to wake them up for work. This wakes up the whole dorm sometimes. A bright light and vibration technology could be included in the bunk 1 to disrupt the sleep of "only" that tenant. An alarm can be included to remind a backpacker of a check-out time by way of a noise, vibration or the like.

The table 65 or movable screen 93 should be easily adjustable in position to facilitate either a person lying flat looking up vertically, or propped up with pillows at a 45 degree angle or sitting upright viewing it horizontally, whilst in the bunk 1.

Many backpackers improve their English during their Working Holiday however some speak limited English when they first arrive. The bunk should provide for multi-languages.

Felt (or similar soft protection surface material) can be located under the load-bearing areas of the base 3 where it meets the floor for evasion of scratching timber or painted floors.

The bunk computer system (digital services package) could form part of an overall hostel management system or be designed to connect with existing process management systems currently in place in hostels. Furthermore, the entire network of bunks 1 can form a global community of travelers with people communicating between hostels.

Artificial Intelligence and Virtual Reality devices and systems could also be included in bunk's functionalities and provide travelers an ability to travel (or preview hotspots) while in their beds. In effect, the bunk becomes an interactive experience.

In another form, the bunk 1 could be adapted for various other transient sleeping environments such as farms, student campuses, caravans, motor homes, luxury boats, aircrafts, private home rentals, private homes for kids, hotels, military campuses, ships and submarines, oil rigs, mining villages, ski chalets, granny flats, hospitals and any other logical place where human beings may sleep and desire the features and functionality and connectivity while they rest.

University campuses could install a version of the present invention. So could private student accommodation facilities typically positioned local to colleges and universities. Variations of designs could be specific to students, such as, for example; English lessons delivered via an accessory to the bunk 1 (as described below as a "Soundproof Helmet" device), or any other educational related internet or electronically delivered methodology. Designs could extend to such facilities like fold-out or slide-out desk top surfaces for student desk work. Such surfaces could include the obvious connectivity ports for laptops etc. For example vertically sliding out of the "pillow end" of the bunk's plastic moulded bed head with engineered recess and slide-out componentry which contains hinge mechanisms and support/reinforcement mechanisms to allow for an ergonomic and efficient and sturdy horizontal desktop. Additionally as an alternative to the need for a chair, a similarly engineered bench seat feature could be engineered to efficiently be encompassed in the bunk's frame design.

Caravans, Motorhomes, Luxury Boats, Aircrafts, and ski chalets have a more compact and lightweight specification, larger or more compact storage compartments, waterproof technology section, connect to an electricity generator, connect to solar panels, connect to batteries, connect to wind power, connect to satellite telephone and internet, energy efficient electric blanket technology or heating technology built into the frame so heat rises through the mattress, built in dehumidifying technology for the purpose of dehumidifying the air for comfort, built in dehumidifying technology for the purpose of generating pure filtered drinking water from moisture in the air, waterproof mattress protectors, any metal usage in the design would typically be non-ferrous, and double bed sized bunks may be commonly used in this sector.

There are many private homeowners and tenants nowadays utilizing their extra space to accommodate guests and are generating revenue. Naturally bunks would work well in such homes as they are space-efficient, and many of the features are appealing to working or tourist travelers.

Where parents may wish to arrange restrictions on internet usage, or monitoring system could be incorporated in the bunks. Privacy curtain 55 and mattress covers could all be covered in artwork. Naturally the entertainment system would be adapted for each market sector, in the kids market more cartoons, games, and preferably differing types of entertainment for each age bracket. For kids and anybody who enjoys playing computer games, there can be joystick and other kinds of game control panel functionalities (not excluding gloves that provide game controls without the need for a control panel) designed for ease of use considering the discomfort gravity can inflict on a human body when lying horizontal enduring arms suspended in the air holding a control panel for a long period of time. Some solutions to this factor could include mattress level controls designed so the eyes do not need to see them while being actively used via the sense of touch.

In a version manufactured on a single story double, queen or king-sized capacity could include high encryption, anti-virus, and anti-hacking measures.

The present invention is not only for backpacker hostels. Some hotels have "family rooms" where there's a combination of a double bed for the parents and bunk beds for the kids as shown in FIG. 14. The single story double or single bunk would typically be desirable to any traveler staying in a hotel. Whereas people across all market sectors lie in their bed nowadays with a smartphone looking up at it while the blood drains out of their vertical arms and their arm muscles tire with such posture, the bunk will provide a comfortable ergonomic choice of positionings to carry on interacting with the digital screen for all the reasons people interact daily through smartphones, laptops, tablets, and TV's. There can also be included in the design, smartphone holders, laptop holders, tablet holders etc where people choose to use their own devices instead of the bunk screen.

The bunk in a preferred form is made of moulded plywood. However, could be made by plastic injection moulding, plastic rotation moulding, MDF or plywood moulding.

Some people install a granny flat in their back yard and rent it out or let a family member live in it. Such a tenant may prefer either a single, double, sized single-story or double-story bunk depending on the nature of the tenant and at the choice of the home owner.

In extreme circumstances whereby a customer orders a bunk to be positioned in a high-rise building vulnerable to the horrific scenario of being trapped by fire, and as an alternative to jumping to a certain death the bunk can encompass a design whereby a person can remove a quick-release provision whereby the majority of the bunk base 3 is left behind and the mattress and plastic base beneath, detaches and with a cover accessory that forms an encapsulated pod that one or more people can strap themselves into and attach either subject to free fall off a balcony relying on a fire-resistant parachute to land the pod without deadly speed of impact, or attach via a "snap lock hook clip" (or similar securing device), to a balcony rail or window frame or internal fixture or fitting with adequate strength and grounding, and suspend the pod over the side of the building and allow a built in wire winding/unwinding hub based device (similar to a winch used on the front of four wheel drive vehicles and abseiling equipment) to allow a controlled prompt but far slower than free fall decent to the street level where typically emergency services would rescue the person or people inside the pod. Preferably this extreme variation of the bunk would include in its design features such as, mattress type padding in the "lid" to the pod as well as the base, oxygen tanks with controlled oxygen release technology ensuring no suffocation to the user, panic button alerting the emergency to pre-programmed friends, family, and emergency services, fast-release fire-resistant parachute technology, prompt but safe lowering technology, metal wire of a thickness that would not be vulnerable to melting quickly, flashing light beacon and loud attention-seeking alarm feature, and fire-resistant and extremely tough shell designed to resist hard impact. Preferably such a product variation would include "airbag type technology" so the entire pod during decent either via parachute or lowering wire/winch mechanism would in a split-second become in the nucleus of a huge "beach ball" type protective padding. Such 360 degree (fire-resistant) spherical protection to the bunk emergency pod would preferably provide a "bounce" and "deadly impact reduction effect" to a person or persons throwing themselves off a burning building or for another emergency reason requiring such extreme measures. The hopeful outcome would be life preservation albeit a dangerous "last resort" procedure. Nevertheless many high-rise residents would keenly invest in such expensive advanced models of the Smart Bunk with the horrific alternatives in mind.

A soundproof helmet (not shown) would be an accessory to the bunk 1 and assist with privacy and delivering media content to tenants. The helmet could contain noise of talking (outgoing noise) whilst also reducing noise incoming to the ears. The helmet could act via Wi-fi, Bluetooth or like in cooperation with the bunk 1. The user could talk on Skype™, a game console, video chat or the like in silence.

The bunk preferably will have multiple design variations ranging from using standard single mattresses to having in-built mattresses with tilting, heating, and various other technologies. Preferably, the bunk 1 includes a tray (not shown) holding the mattress that can be slid out away from the bunk 1 to allow easy changing of the sheets or cleaning.

Preferably the invention will provision for retrofit of sleep aiding sounds such as white noise, music, therapeutic sounds and the like via speakers positioned inside the bunk or via headphones in the digital services package and providing a user a better sleep. It will be able to retrofit a radio, either hard wired to electrical mains, battery operated, or spring powered via a wind-up methodology. Evaporators or the like could be utilised to add insect repellant and/or mould repellant to the air flow of the bunk's interior.

Ducting apparatus within the channel 98 and/or attachment holes 13 preferably can be included that would provide air flow, expelling air, inputting air, cooling air, heating air, cleaning air, connecting via ducting to existing air conditioning systems in addition to a fan whether with blades or without blades. Air cleaning technologies such as field science methodologies, either magnetic or otherwise, or air freshening chemical or herbal methodologies to discourage toxic particles from inside the bunk's internal space and further include in the embodiment of the design a smoke and Carbon Monoxide detection device with retrofit provisioning for such to allow for air cleaning methodologies and safe air quality and endangerment levels to be communicated to the occupying person via alarm or siren and/or increased lighting, email or SMS whereby it is not an emergency, or other logical automated communication methodology.

In a preferred form, mould detection and elimination of airborne mould spores prevention is inclined which are typically invisible to the human eye in their early growth phase albeit a threat to health, preferably in the form of natural gasses or other molecular airborne forms defense against said mould.

In one embodiment the bunk 1 includes provision for retrofit of electricity generating devices such as solar panels, fuel driven generator, wind power or the like to power a smart bunk typically in a remote location without mains electricity availability.

Motion sensors can be included beneath the mattress and in holes in the bunk's shell which are typically used by bed bugs to hide in during the day. Further addition of removable sections would preferably act as a capturing device such as a sticky adhesive product used to stick the bed bugs to the capturing device to prove bed bug presence in each bunk. This could for example be located in the services panel 110. Therefore the combined use of glue or sticky adhesive materials in concert with motion detectors acting together as a detection methodology system for bed bugs. Furthermore an electronic alert system could be attached to this monitoring system in order to alert the user or management of the bunk's location of the likelihood of such motion sensors causing suspicions of bed bug movements within such hiding places.

Addition and provision for retrofit of a periodic expelling device (such as a vaporizer or evaporator or the like) which would preferably expel an insect deterrent for both bed bugs and general insects and mosquitos away from the bunk similarly to automated air freshener devices positioned to freshen air. There could be a compartment under the mattress to house insect repellent and/or mould repellent.

In an alternative version of the product whereby the presence of mosquitos is problematic, a fly screen (not shown) may replace the privacy blind or accompany a privacy blind to provide the option to prevent such mosquitos entering the internal bunk space.

In an alternative version of the product whereby noise pollution is problematic a soundproofed privacy blind may be used to soundproof the bunk somewhat. Such a sound-resistant privacy blind would typically cover the aperture horizontally albeit some versions may be vertically operational. Whereas an ordinary privacy blind would be either vertically or horizontally designed to cover the bunk's aperture with a retractable nature preferably spring-loaded on a circular axis, a sound-resistant version of a blind would typically be too thick in nature, however it would typically have rails holding it against the surface of the wall to avoid gaps for noise to enter.

For the purpose of provisioning for noisy locations and for the purpose of removing hollowness or cheapness of the feel of the bunk to the users, in a manufacturing process preferably utilised for the bunk product called rotation moulding of plastic, it is intended that such rotation moulding process would involve a cavity remaining inside the walls of the bunk whereby a soundproofing and insulation foam can be injected to reduce such noise pollution.

Addition and provision for retrofit of a mattress shelf/draw whereby the making of the bed with sheets could be easier whereby the entire mattress slides out on rails (not shown) like a draw. Due to sheet-changing labour intensity some hostel owners are concerned about the climbing into the top bunk×300 bed changes per week and being too hard and expensive labour cost to be viable. A hinge to the side or top of the bunk wall (above or beside the aperture) and a key lock by the grab handle and shortening the ladder and for the entire side of the upper bunk wall to swing open like a big cupboard or open from the bottom with a support rod like a car bonnet, so a cleaner can stand on a step ladder and make both the top and bottom beds more easily.

Addition and provision for retrofit of the screen whether TV, tablet, touch-screen sensitive or remote controlled via infrared control or otherwise, a transparent flat material could be utilized to form a protective screen whereby the screen could be encased behind the protective screen to avoid vandalism of the screen and any other expensive componentry cased within.

For the purpose of stability of the bunk's structure on an uneven floor the invention would benefit from adjustable feet (not shown) or if sitting flat on a mat or plinth, then a methodology for heightening the corners to compensate for unevenness.

The invention would in some forms of product variation have windows with electrochromic technology commonly used in rear view mirrors of cars, and automatic dimming of airplane windows. Such technology would offer automatically or manually operated dimming facilities and hence light emission options for the user to regulate with preferred sleep patterns.

In an advanced form the invention may preferably encompass adjunct modular devices such as a shower or toilet facility, vertical locker, office, living room, workstation or wardrobe. The invention has the scope to double on a mirror image basis to form a king sized bunk and furthermore stretch further using the width of more than two single sized bunk shells therefore increasing the width to two or more king sized mattress widths. Such a stretched version of the product could provide for extra space not solely for sleeping but also for study with a work space solution encompassed in parallel to the designated sleeping position, and furthermore the upper bunk could be used for a differing purpose than the lower bunk for example a living room upstairs and bedroom downstairs, or vice versa, and furthermore an internal staircase could be included. An example is shown in FIG. 14. The bottom of the bunk could include a trundle style roll out bed with a draw that can be pulled out when extra bedding is required.

In an alternative form there may be the provisioning for lighting on the ladder rungs whereby they light up when stepped on. Such a feature would preferably be engineered with the use of pressure sensors and appropriate LED lighting technological solutions to create such an effect. Such a feature would provide light at the height of the feet of the user appropriate to the stage of the ladder the person is either climbing up or down it. Therefore providing light in the night when visiting the bathroom or arriving home or departing the bunk in the dark. This would reduce risk of slippage and remove the necessity to switch on a light manually. Furthermore this feature may be regulated by daylight sensors to ensure it only works in the dark and therefore does not waste unnecessary electricity lighting up during the day.

In an alternate form, the product includes an evolving retrofittable electricity and control digital services panel would preferably provision for evolving connectivity. For example in addition to standard intended USB, electric socket, Aux, headphones jack plug, it would preferably contain hard-wired connectivity such as HDMI, USBC, and other upcoming connectivity as well as wireless connectivity methodologies such as Microwaves, Two-Way Radio communication, Bluetooth, Satellite Communication, Infrared, Ultrasonic, and the like.

In a design variation whereby an open roof is desirous the bunk ceiling may provide for a sunroof for either the purpose of allowing in sunshine or daylight, or for the purpose of sprinkler systems in commercial accommodation locations to access the water into the top of a bunk in the event of a fire.

Furthermore the ceiling of the bunk may be furnished with technology that gives an artificial impression of a starlit sky. Similarly to the usage of the same in top end luxury motor cars this effect would typically be created by a combination of delicate fibre optic strands into a leather or synthetic alternative material ceiling lining at varying depths and at differing angles to create such effect. It could also be imbedded in glass or acrylic or similar harder materials for the users who wish to gaze at artificial stars or scenery while in bed.

In an advanced variation of the invention it may encompass massage technology for the comfort of the user, similarly to massage chairs commonly used this invention could utilise a variation applicable in a horizontal position albeit could also be in a sitting up position either in various design configuration variations.

For the purpose of varying desirous themes for the entertainment and usage of the bunk users, a variety of aesthetic characteristics could be included in the design such as for example the market of servicing hiking pilgrims walking the camino trails of Europe, a bible holder and crucifix facility could be encompassed in the bunk for praying purposes. Furthermore design provisioning for kneeling in a praying manner would preferably be provisioned.

Removable decals for specific themed locations changing of displayed artwork or branding would be preferable, for example kids bedroom themes moving with age brackets of the growing user over time, and sports participants with bunks branded to their name and identity, and temporary sleeping solutions with branded event artwork such as the Olympics, and the like.

For the purpose of avoidance of vandalism the provisioning of a special tool applicable to the joinery and fastening methodology adopted in the fabrication of the bunk invention. This may be introduced to the product whereby for example a youth traveler with a phillip head screwdriver is unable to remove rivets, or screws or other fastening apparatus applied by the designated installer equipped with said special tool.

In an advanced form of the invention camera technology may be introduced into the bunk for the purpose of it acting as a photo booth.

In an advanced and customised form of the invention the bunk may be reformed to match that of a themed shape such as for example a VW camper van, or a Vespa motorcycle, or other creative shaping of the same invention to satisfy theme-driven users. Furthermore multiple versions of the bunk invention may be grouped together and installed into busses whereby busses can be converted to space-efficient and portable sleeping solutions.

Preferably the plinth would contain provisioning for sound resistance to dampen the noises passed between the bunks when in stacked configuration.

Preferably the bunk invention design would provide shrunken versions for usage by children, pets, or small people.

Preferably where spare space in the frame of the invention exists, for example a hollow unused space, various technological hardware could be positioned strategically to use such space for example, dehumidifier machine, desalination machine, set top box, gaming machine, electricity generator, refrigeration machine, and the like.

Preferably a bendy arm with smartphone or tablet holder would be retrofittable within the bunk for ergonomic and convenient suspending of such media device above the pillow area and adjustable universally around the pillow area for such comfortable viewing, and furthermore in close proximity to a charging point within the bunk.

Preferably for usage of the bunk invention in dangerous environments various provisioning would be included in the variations such as a panic button, a locking method of a hard door to the bunk. Likewise in refugee help zones, military zones, security zones etc, toughening methodologies would be added to the invention for the purposes of added personal protection, for example manufacturing from bulletproof materials.

Preferably the bunk invention would provide users with opportunities to make electronic payments or access a safe or locker within the invention and therefore provisioning for inclusion in the design of secure payment technologies such as hardware and software to allow for QR code reading, credit card tapping/scanning, finger print readers, facial recognition scanners, eye renter scanners, and the like as part of the digital services package.

Preferably the bunk invention would encompass a food delivering service provisioning for electronic communication to a food delivery service provider.

Preferably a rotation moulded plastic manufacturing process which can allow for a component of recycled plastic can me included, however in alternative forms it could be made from any structurally safe and sound material for example metal, timber, carbon fibre, honeycomb shaped materials, rubber, and the like.

Preferably the surface of the bunk, especially near the floor and for the locker units, the product will contain provisioning for a smooth surface that is difficult for bed bugs to climb up. Examples of this would be smooth surfaced stainless steel, rotation moulded plastic with smoothing polish applied to the inside of the die, melamine coatings and the like. The bunk 1 could also include glowing paint to assist with locating your bunk 1 over another and for safety using the ladder.

Preferably the invention would have a bed head that transforms into a back support for the purpose of users comfortably sitting up in their bunk. Such a dual-purpose device would provide back support as well as head protection separating solid bunk wall material from the pillow area.

Preferably usage of space such as above the feet in the bunk attached to the ceiling would be a retrofit accessory such as a vending machine device which would provide applicable products to tenants in transient scenarios such as backpackers purchasing sachets of washing powder, SIM cards, single serve shampoo/soap/toothpaste and other products commonly sold or provided for free by hotels.

Preferably the invention will encompass provisioning for bolting to the floor and/or wall for the purpose of avoiding tilting and toppling.

Preferably in a ski resort location the invention would have a slot and/or holder designed for storage of skis.

Preferably the invention would have an accessory allowing for an electrical pump to inflate an inflatable mattress next to the bunk for occasional visitors, and a storage compartment to fold said inflatable mattress and pump into.

Preferably where a bunk is intended to be positioned in a location vulnerable to tsunamis the bunk will be provisioned with a locking watertight door to the aperture, oxygen tank and mask equipment, additional reinforcement to withstand hard impacts internally and externally, and a beacon for emergency services to be able to locate the bunk with a tsunami survivor within.

Preferably, the bunk 1 comes in a kit form and is manufactured on site. In FIG. 14, the wardrobe could also be a single or double media room for watching TV and talking on Skype™ calls and not annoy other guests.

Smart Bunks could be fitted with audio technology microphone sensors detecting snoring and have machinery which inflates air bladders either under the mattress, inside the mattress, or inside the pillow which raises the head position to stimulate muscles in the nasal and neck area which opens the tubes that cause snoring when relaxed. Bluetooth technology could be used to communicate between the inflating mechanism and the microphone audio technology device.

Smart Bunks could have magic mirrors technology utilised whereby on the external walls of the bed frame mirrors doubling up as electronic billboards that display advertising until someone gets close to the mirror sensed by a motion sensor or similar type of sensor, whereby the device acts as a mirror until the person has walked away from it then it reverts to an electronic billboard. Furthermore a SIM card could be fitted into the device for both centralised control of electronic advertising content and also to provide the Smart Bunk with mobile phone internet network technology, such as 4G, to act as an alternative to local WIFI, or as an additional source for back-up when WIFI fails.

Smart Bunks aperture may be varied to provide mosquito nets, removable and washable curtains, soundproof door, locking safety door, or the like, and also in an alternative form have a hinging mechanism allowing the bottom part of the wall of the Smart Bunk to lift up allowing easier access to the mattress for more efficient sheet changing. Such a hinged flap could have a lock accessible by a master key designated for hostel operator or other commercial management ownership when sheet changing is required.

In an alternative form the shape of the aperture may vary to allow for configuring two Smart Bunks in an L-shaped position without the end of the Smart Bunks blocking the entire section that is recessed below mattress level for easy access. The guardrail type section typically more useful for safety provisioning on the upper bunk, would ordinarily be removed to form a less restricted part of the aperture for climbing into the bed comfortably with the aperture edge being below mattress level. In such an L-shaped configuration the top bunk with ladder access would by non-restricted due to its partially symmetrical nature.

In an alternative form the Smart Bunk could have a central axis through the plinth separating the two beds and through the plinth separating the lower bunk from the locker beneath, and the entire lower bunk could twist to a 90 degree angle to both the top bunk and the locker. The twisted configuration could form the basis of an upstairs balcony or the like. In such an alternative form the external section of the end of the lower bunk could be redesigned to incorporate a ladder or in-built steps so the tenant would be climbing up the end part of the below bunk to access the upstairs bunk when at right angle to the other and therefore the usual ladder could be removed from such a version.

The aperture may be varied to facilitate alternative entry designs and further due to its modular form the top bunk could have its aperture opening on the opposite side to the bottom bunk and vice versa where in a one-sided application, as an alternative to a double-sided aperture opening, and further as an alternative to an end-entry design whereby the tenant would enter via an aperture in the end of the bunk's wall.

In an alternative form preferably the Smart Bunks design would be duplicated from plywood with laminates, veneers, embossing technologies, and artwork printing providing for a tough, easy to clean smooth surface, and utilising plywood moulding techniques to bend the plywood by steaming and resetting the internal glues in the plywood layers to form the curved corners and flat walls of the Smart Bunk. Furthermore in such a modular plywood form a combination of the straights and the curved components would conveniently form the shell of a vertical locker unit. Alternatively, the bunk would be 3D printed using carbon fiber or the like and could include technology sheets, embedded in the walls. These could include smart sensors.

In an advanced form the Smart Bunk locker draws could be redesigned to allow for the slotting in of Smart Bunks uniquely designed suitcases. These suitcases could be specifically designed to include rails or ridges or recesses or the like to accommodate such suitcases. The suitcases would become part of the Smart Bunk for aesthetic and efficient storage purposes and include locking mechanisms. The Smart Bunks specific suitcase accessory could contain GPS and also solar panels to collect energy for the GPS or any other electrically driven technology that is included in the said suitcase. The GPS would enable the Smart Bunks computer system to monitor the whereabouts of the suitcase for purposes such as a Smart Bunks app marketing system, or for theft security monitoring, or missing persons Police date purposes or the like.

Smart Bunks could include in its design a wireless device charging pad to avoid use of charger wires for phones and tablets and the like.

Although the invention has been described with reference to specific examples, it will be appreciated by those skilled in the art that the invention may be embodied in many other forms.

The invention claimed is:

1. A modular stackable bunk bed, the bunk bed comprising:

an elongate base, an elongate roof, a pair of ends spaced apart by a pair of sides, at least partially connecting the base to the roof to form a living space;

at least one raised portion extending along the base and/or roof and adapted to elevate the base and/or roof away from a floor surface and/or another bunk bed, at least one hole adapted to receive a fastener to connect two said bunks together; and a digital services package to provide digital services including a computer system and a screen, wherein the digital services package is configured to send and receive digital data to a user of the bunk bed;

a ladder that is configured to attach at least two of the bunk beds together, wherein the at least two of the bunk beds are in contact with one another by a roof of one bunk bed and a base of a second bunk bed, and wherein the base and/or roof base comprise a plurality of raised portions, the raised portions defining channels to receive cabling and provide air flow, wherein the bunk bed comprises a ventillation system to circulate air about the bunk bed via a ducting apparatus within the channels, and wherein the base includes a top surface and a bottom surface, the top surface being generally planar and defining a generally horizontal axis, the top surface comprising a panel movable with respect to the planar surface, which is configured to provide a user a support angled from the axis so that the user can sit up in bed and wherein a mattress is placed on the top surface.

2. The bunk of claim 1, wherein the base is manufactured from plywood.

3. The bunk of claim 1, wherein the bunk is coated with an anti insect repellant and/or mould repellant.

4. The bunk of claim 1, wherein the fastener includes a nut and bolt adapted in use to secure a base of one bunk with a roof of another bunk.

5. The bunk of claim 1, wherein the ventillation system is adapted to deliver an insect repellent and/or mould repellant to the circulating air.

6. The bunk of claim 1, wherein the sides include a surface adapted to receive advertising.

7. The bunk of claim 1, wherein the sides include a closed panel and an open cut out, the open cut out including a retractable privacy screen.

8. The bunk of claim 1, wherein the bunk includes a lockable drawer.

9. The bunk of claim 1, wherein the digital services package of one bunk is adapted to communicate with a digital services package of another bunk and/or a central server, to permit communication between the bunks and/or server and/or record data of bunk usage.

10. The bunk of claim 1, wherein the end includes a removable services panel.

11. The bunk of claim 1, wherein the side includes a tray holding the mattress and slidable away from the bunk to allow easy making of a bed.

12. The bunk of claim 1, wherein the side includes a hinged flap movable from an open position to a closed position, providing access to the mattress to permit sheets on the mattress to be changed easily.

* * * * *